United States Patent [19]

Wilson

[11] Patent Number: 4,904,949

[45] Date of Patent: Feb. 27, 1990

[54] SYNCHROTRON WITH SUPERCONDUCTING COILS AND ARRANGEMENT THEREOF

[75] Inventor: Martin N. Wilson, Abingdon, United Kingdom

[73] Assignee: Oxford Instruments Limited, Osney Mead, United Kingdom

[21] Appl. No.: 770,270

[22] Filed: Aug. 28, 1985

[30] Foreign Application Priority Data

Aug. 28, 1984 [GB] United Kingdom ..... 8421867

[51] Int. Cl.[4] ..... H05H 13/04

[52] U.S. Cl. ..... 328/235; 505/879

[58] Field of Search ..... 328/235, 237

[56] References Cited

PUBLICATIONS

"The Racetrack: A Proposed Modiciation of the Synchrotron", by H. R. Crane, *Physical Review,* vol. No. 69, pp. 542–543, 1946.

"The Theory of the Synchrotron", by D. Bohm et al, *Physical Review,* vol. No. 70, Nos. 5 and 6, pp. 249–258, Sep. 1946.

*Primary Examiner*—Palmer C. DeMeo

*Attorney, Agent, or Firm*—Spencer & Frank

[57] ABSTRACT

A synchrotron having at least two sets of super-conducting coils, each arranged for deflecting charged particles in a curved path. The sets of superconducting coils are spaced to provide at least one straight portion of the path for the particles. A transformer device is located along the straight portion of the path for accelerating the particles to operating energy. At least one coil has its main go and return arms curved to lie substantially parallel to the required curved path and at least one coil has only its main go arm curved to lie substantially parallel to the path.

16 Claims, 2 Drawing Sheets

SYNCHROTRON WITH SUPERCONDUCTING COILS AND ARRANGEMENT THEREOF

BACKGROUND OF THE INVENTION

This invention relates to synchrotrons, which are devices for increasing the energy of charged particles by causing them to travel in a curved path and thereby pass repeatedly through a radio frequency accelerating cavity. Synchrotrons are used for a number of research and manufacturing applications using either the charged particles or the radiation which they emit. In one application the charged particles are electrons which are made to emit radiation in the "soft" X-ray range, having wavelengths in the range 1 Angstrom to 100 Angstrom, the radiation being given off at a tangent to the path of the electrons and, therefore, being emitted as an arc-shaped beam of narrow angle in the transverse direction.

In order to produce radiation in this range using conventional resistive electromagnets, the size of the synchrotron has to be fairly substantial and, for example, to produce the frequency of radiation required for X-ray lithography in a synchrotron using electrons, the synchrotron would have to be of the order of ten meters in diameter or more.

The use of superconductors to produce the magnetic field needed to deflect the electrons in the required curved path would reduce the size of the device substantially but it would, nevertheless, still be quite large and would still be expensive to manufacture. For example, it has been proposed to make the superconducting coils circular and to contain the radio frequency accelerating cavity within the aperture of the coils. However, because the radio frequency cavity must be of substantial size, the size, weight, force level and stored energy of the magnet system would all be correspondingly large and, therefore, expensive to manufacture. Of particular concern would be the requirement for a large power supply, arising from the large amount of magnetic energy the system would store.

The present invention seeks to minimize the magnet size, weight, force level and stored energy by using a design which is extremely compact.

SUMMARY OF THE INVENTION

According to the invention there is provided a synchrotron having at least two sets of superconducting coils, each arranged for deflecting charged particles in a curved path, said sets being spaced to provide at least one straight portion of the path for said particles, a transformer device located along said portion of the path for accelerating said particles to operating energy, and wherein each of said coil sets includes:

(i) at least one coil having its main go and return arms curved to lie substantially parallel to the required curved path, and (ii) at least one coil having only its main go arm curved to lie substantially parallel to said path.

Preferably, the coil sets are spaced to provide at least two straight portions of the path and wherein a radio frequency accelerating cavity is positioned along the second such path.

Preferably also, the synchrotron has two coil sets spaced apart to provide a "race track" shaped path for the charged particles so that each set of superconducting coils has a curved path which turns the particles through substantially 180°.

BRIEF DESCRIPTION OF THE DRAWINGS

An embodiment of the invention will now be described, by way of example only, with reference to the accompanying drawings, in which.

DESCRIPTION OF THE PREFERRED EMBODIMENT

Figure 1:
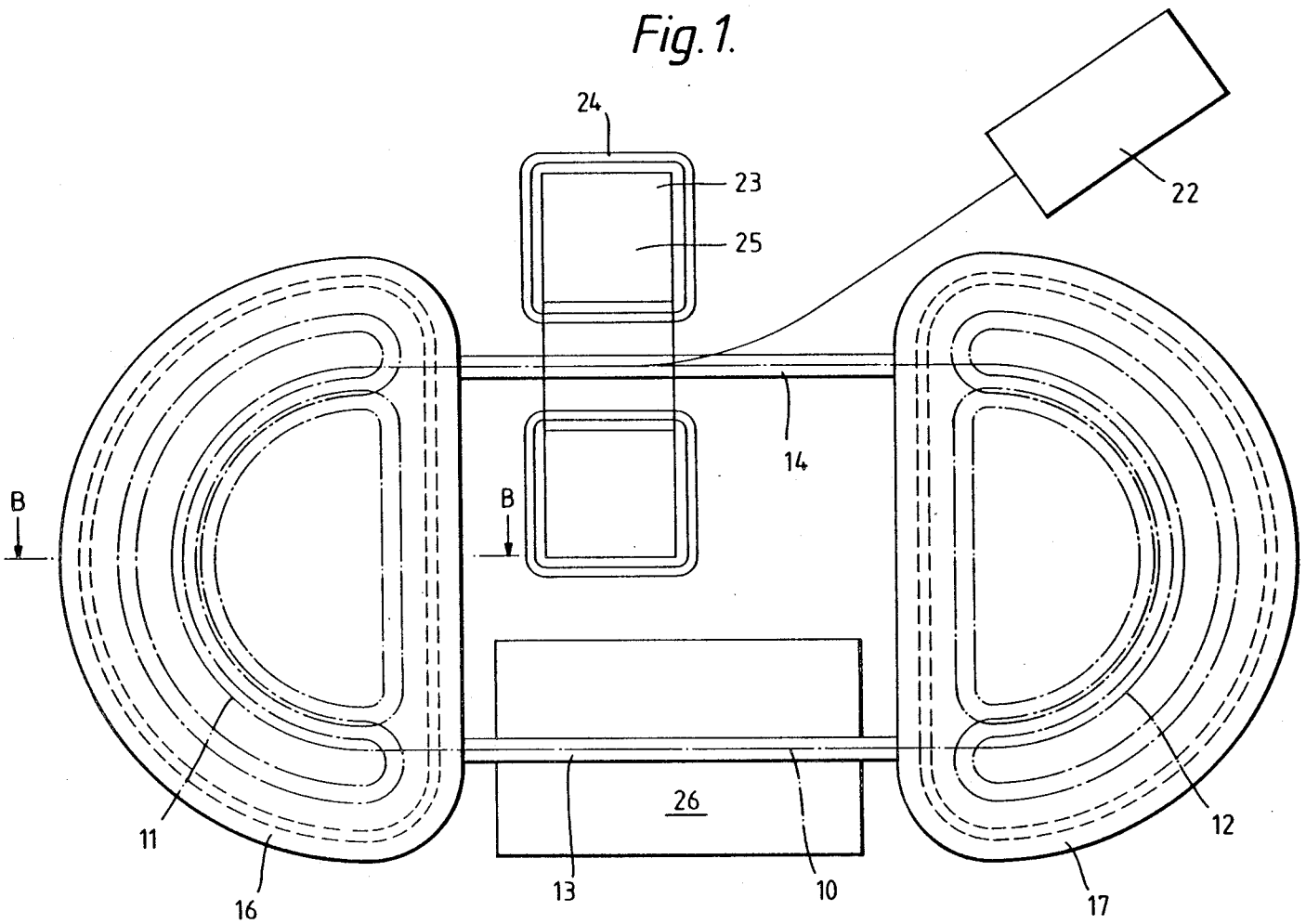
FIG. 1 is a plan view of the synchrotron, and, FIG. 2 is a part-section along the line B—B in FIG. 1 and to a different scale.

In FIG. 1 the path which it is desired the electrons should follow in operation, is shown by the broken line 10. Line 10 comprises two semi-circular portions 11, 12, joined by two straight portions 13, 14, and it can be seen to form a "race track" shape. The whole of the path 10 lies within a vacuum chamber which is not specifically shown in the drawings. Within this chamber there are two cryogenic vessels 16, 17 each containing a set of superconducting coils.

Electrons are projected into the device by an injector 22 which injects electrons into portion 14 of the required electron path at an energy level of about 100 KeV. The electrons pass through a transformer device 23, which comprises a core 25 and a series of coil turns 24. This device operates by a form of transformer action generally known as "betatron acceleration". Electrons passing along path 10 appear to the transformer to constitute turns of linking secondary coils and thus a current applied to the coil turns 24 affects the electrons passing along path 10 and the electrons can be made to accelerate up to the required energy level of about 10 MeV by appropriately increasing this current.

This acceleration is achieved while confining the electrons to path 10 by increasing the current in the coil sets of vessels 16, 17 in synchronism with the increase in current in the transformer device 23.

Surrounding portion 13 of the race track path is a radio frequency accelerating cavity 26 which accelerates the electrons up to between 10 and 600 MeV, along with a further increase in the current in the coil sets of vessels 16, 17. Cavity 26 keeps the electrons at the required energy level, replacing the energy lost in the form of radiation.

Figure 2:
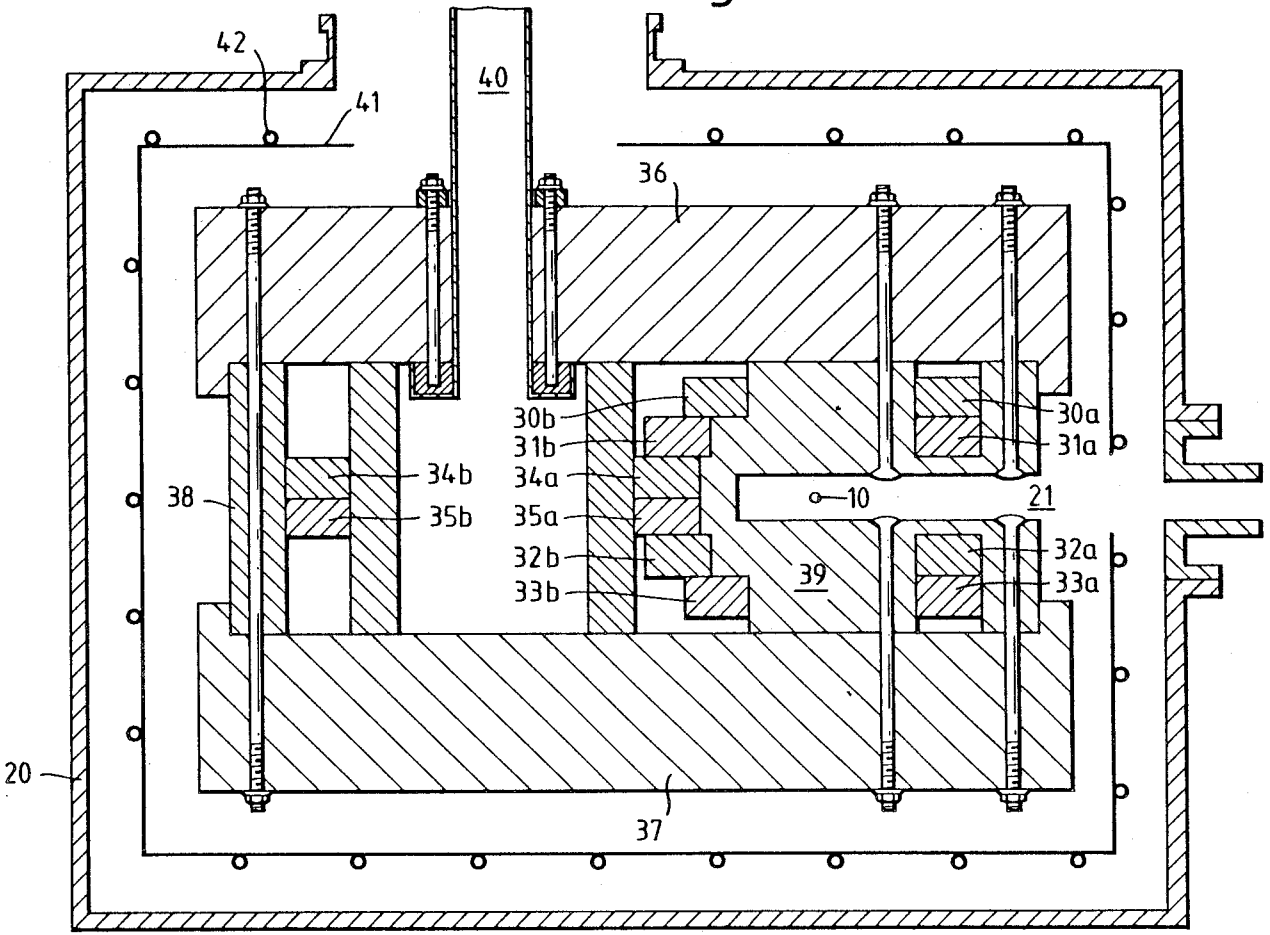

Referring more particularly now to FIG. 2, the cryogenic vessel 16 is enclosed within a casing 20. The casing has a re-entrant 21 of rectangular cross section, which extends all around the semi-circular outer periphery of the casing and which contains the path 10 for the electrons. The superconducting coil is made up of six separate windings, four of which have their main go and return arms lying parallel to the semi-circular path 11. Thus, the top coil as seen in the Figure, has a go arm **30*a* and a return arm 30*b* and, similarly, the other coils have go and return arms 31*a* and 31*b*, 32*a* and 32*b*, 33*a* and 33*b* all lying substantially parallel to the semi-circular path portion 11**.

These coils all lie on a former 36 made of non-magnetic and non-conducting material, such as an epoxy resin composite, and together they provide a substantially uniform magnetic field all around the re-entrant 21.

In addition, a further pair of coils 34, 35 is provided in which the arms **34*a*, 35*a* lie parallel to the electron path portion 11 but the return arms 34*b*, 35*b* extend diametrically across it. The coils 34, 35 provide a gradient field all around the re-entrant 21, this gradient field being of higher intensity at the radially inner part of re-entrant 21. The field which is produced in re-entrant 21 is a combination of the uniform field produced by coils 30 to 33 and the gradient field produced by coils 34 and 35** and this combined field is capable of deflecting the electrons around the desired path.

The field supplied by these coils has to be increased as the electrons are accelerated up to the required potential and, for this reason, the former 36 is made of a non-magnetic material to avoid eddy current problems. Although an epoxy resin composite has been mentioned above, former 36 could be made from a stainless steel material.

A cryostat vessel is formed by two supports 36 and 37, an outer wall 38 and an inner support wall 39. The vessel is filled with liquid helium so that the coils operate at 4.2° K. The leads for the coils are not shown but they are led out through a neck 40 and the cryostat is surrounded by a cooling enclosure 41 which has coils 42 attached to its outer surface in good thermal contact therewith, the coils containing liquid nitrogen at 78° K.

What is claimed:

1. A synchrotron having at least two sets of superconducting coils, each arranged for deflecting charged particles in a curved path, said sets being spaced to provide at least one straight portion of the path for said particles, a transformer device located along said portion of the path for accelerating said particles to operating energy, characterized in that at least one coil (30, 31, 32, and 33) has its main go and return arms curved to lie substantially parallel to the required curved path (11, 12) and at least one coil (34, 35) has only its main go arm curved to lie substantially parallel to said path (11, 12).

2. A synchrotron as claimed in claim 1, characterized in that the coil sets (16, 17) are spaced to provide at least two straight portions (13, 14) of the path and that a radio frequency accelerating cavity (26) is positioned along one of said two straight portions (13, 14).

3. A synchrotron as claimed in claim 1, characterized in that the coil sets (16, 17) are spaced apart to provide a race track shaped path (10) for the charged particles so that each set of superconducting coils (30–35) provides a curved path which turns the particles substantially through 180 degrees.

4. A synchrotron as claimed in claim 2, characterized in that the coil sets (16, 17) are spaced apart to provide a race track shaped path (10) for the charged particles so that each set of superconducting coils (30–35) provides a curved path which turns the particles substantially through 180 degrees.

5. A synchrotron as claimed in claim 1, characterized in that the coils are symmetrically arranged in pairs (30,33 and 31,32 and 34,35) about the path (10).

6. A synchrotron as claimed in claim 2, characterized in that the coils are symmetrically arranged in pairs (30,33 and 31,32 and 34,35) about the path (10).

7. A synchrotron as claimed in claim 3, characterized in that the coils are symmetrically arranged in pairs (30,33 and 31,32 and 34,35) about the path (10).

8. A synchrotron as claimed in claim 4, characterized in that the coils are symmetrically arranged in pairs (30,33 and 31,32 and 34,35) about the path (10).

9. A synchrotron as claimed in claim 1, characterized in that an electron injector (22) is arranged for injection of charged particles into said path (10).

10. A synchrotron as claimed in claim 2, characterized in that an electron injector (22) is arranged for injection of charged particles into said path (10).

11. A synchrotron as claimed in claim 3, characterized in that an electron injector (22) is arranged for injection of charged particles into said path (10).

12. A synchrotron as claimed in claim 4, characterized in that an electron injector (22) is arranged for injection of charged particles into said path (10).

13. A synchrotron as claimed in claim 5, characterized in that an electron injector (22) is arranged for injection of charged particles into said path (10).

14. A synchrotron as claimed in claim 6, characterized in that an electron injector (22) is arranged for injection of charged particles into said path (10).

15. A synchrotron as claimed in claim 7, characterized in that an electron injector (22) is arranged for injection of charged particles into said path (10).

16. A synchrotron as claimed in claim 8, characterized in that an electron injector (22) is arranged for injection of charged particles into said path (10).

* * * * *